US008858031B2

(12) United States Patent
Szoradi et al.

(10) Patent No.: US 8,858,031 B2
(45) Date of Patent: Oct. 14, 2014

(54) LIGHT ENGINE DEVICE WITH DIRECT TO LINEAR SYSTEM DRIVER

(75) Inventors: Charles Attila Szoradi, Wayne, PA (US); Sean Russell Darras, Philadelphia, PA (US); Gerald Edward Frazee, Weatogue, CT (US); Paul Prior, Birdsboro, PA (US)

(73) Assignee: Independence LED Lighting, LLC, Devon, PA (US)

( * ) Notice: Subject to any disclaimer, the term of this patent is extended or adjusted under 35 U.S.C. 154(b) by 469 days.

(21) Appl. No.: 13/188,029

(22) Filed: Jul. 21, 2011
(Under 37 CFR 1.47)

(65) Prior Publication Data

US 2012/0062129 A1 Mar. 15, 2012

Related U.S. Application Data

(60) Provisional application No. 61/366,767, filed on Jul. 22, 2010.

(51) Int. Cl.

| | |
|---|---|
| ***F21V 21/26*** | (2006.01) |
| ***F21V 19/00*** | (2006.01) |
| ***F21S 4/00*** | (2006.01) |
| *F21Y 101/02* | (2006.01) |

(52) U.S. Cl.

CPC ..... *F21V 9/17* (2013.01); *F21V 19/003* (2013.01); *F21S 4/008* (2013.01); *F21Y 2101/02* (2013.01)

USPC ..... 362/269; 362/270; 362/217.12; 362/294; 315/312; 315/318; 315/294

(58) Field of Classification Search

CPC ... F21V 21/005; F21V 17/18; H01R 33/0854; H01R 33/0863; H05B 37/029; H05B 37/0254

USPC ..... 362/227, 246, 249.02, 269, 275, 294, 362/299, 300, 217.08, 217.12, 270; 315/312, 316, 318, 319, 307, 297, 292, 315/360, 362, 294

See application file for complete search history.

(56) References Cited

U.S. PATENT DOCUMENTS

| | | | |
|---|---|---|---|
| 5,667,736 | A | 9/1997 | Chien |
| 5,966,110 | A | 10/1999 | Van Zalinge |

(Continued)

FOREIGN PATENT DOCUMENTS

| | | | |
|---|---|---|---|
| EP | 1479270 | B1 | 7/2006 |
| EP | 1461980 | B1 | 10/2006 |

(Continued)

OTHER PUBLICATIONS

International Application No. PCT/US2011/044854, International Search Report, dated Nov. 7, 2011, 2 pages.

(Continued)

*Primary Examiner* — Haiss Philogene
(74) *Attorney, Agent, or Firm* — Blank Rome LLP

(57) ABSTRACT

A lighting system adapted for being retrofit into a conventional lighting fixture, or adapted to replace the conventional fixture. The lighting system includes a lighting device having a substrate and a plurality of light-emitting elements disposed on the substrate. The lighting system further includes a power supply for delivering D/C current to the lighting device. The lighting device may be installed into a conventional lighting socket in the conventional lighting fixture or mounted independently utilizing some parts of the conventional fixture. The power supply is installed into the conventional lighting fixture or other suitable fixture external to the lighting device. In exemplary embodiments, the lighting system includes a plurality of lighting devices rotatably mounted in the conventional lighting fixture. Each lighting device is powered by an independent power supply and may be independently rotated and powered to customize light coverage.

15 Claims, 14 Drawing Sheets

(56) References Cited

U.S. PATENT DOCUMENTS

| | | | | |
|---|---|---|---|---|
| 6,359,392 | B1 | 3/2002 | He | |
| 6,528,954 | B1 | 3/2003 | Lys et al. | |
| 6,577,512 | B2 | 6/2003 | Tripathi et al. | |
| 6,682,211 | B2 | 1/2004 | English et al. | |
| 6,762,562 | B2 | 7/2004 | Leong | |
| 6,853,150 | B2 | 2/2005 | Clauberg et al. | |
| 6,853,151 | B2 | 2/2005 | Leong et al. | |
| 7,038,399 | B2 | 5/2006 | Lys et al. | |
| 7,042,165 | B2 | 5/2006 | Madhani et al. | |
| 7,067,992 | B2 | 6/2006 | Leong et al. | |
| 7,071,633 | B2 | 7/2006 | Gallagher et al. | |
| 7,114,830 | B2 | 10/2006 | Robertson et al. | |
| 7,116,294 | B2 | 10/2006 | Stopa | |
| 7,135,825 | B2 | 11/2006 | Tanabe | |
| 7,150,553 | B2 | 12/2006 | English et al. | |
| 7,180,486 | B2 | 2/2007 | Jeong | |
| 7,233,115 | B2 | 6/2007 | Lys | |
| 7,236,154 | B1 | 6/2007 | Kerr et al. | |
| 7,256,554 | B2 | 8/2007 | Lys | |
| 7,262,559 | B2 | 8/2007 | Tripathi et al. | |
| 7,284,874 | B2 | 10/2007 | Jeong et al. | |
| 7,350,936 | B2 | 4/2008 | Ducharme et al. | |
| 7,358,706 | B2 | 4/2008 | Lys | |
| 7,369,060 | B2 * | 5/2008 | Veskovic et al. | 340/4.3 |
| 7,372,441 | B2 | 5/2008 | Gallagher et al. | |
| 7,394,444 | B2 | 7/2008 | Kim et al. | |
| 7,414,271 | B2 | 8/2008 | Jeon | |
| 7,420,217 | B2 | 9/2008 | Jeon | |
| 7,488,086 | B2 | 2/2009 | Wu et al. | |
| 7,490,951 | B2 | 2/2009 | Klipstein et al. | |
| 7,490,957 | B2 | 2/2009 | Leong et al. | |
| 7,496,297 | B2 | 2/2009 | Sun et al. | |
| 7,507,001 | B2 | 3/2009 | Kit | |
| 7,556,396 | B2 | 7/2009 | Kuo et al. | |
| 7,618,157 | B1 | 11/2009 | Galvez et al. | |
| 7,639,219 | B2 | 12/2009 | Gallagher et al. | |
| 7,670,040 | B2 | 3/2010 | Park | |
| 7,728,798 | B2 | 6/2010 | Kim | |
| 7,781,985 | B2 | 8/2010 | Cross | |
| 7,791,498 | B2 | 9/2010 | Park | |
| 7,802,902 | B2 | 9/2010 | Moss et al. | |
| 7,802,903 | B1 | 9/2010 | Wray | |
| 7,808,189 | B2 | 10/2010 | Hollnberger et al. | |
| 7,872,621 | B2 | 1/2011 | Lee | |
| 7,891,853 | B2 | 2/2011 | Park | |
| 7,946,729 | B2 | 5/2011 | Ivey et al. | |
| 8,125,127 | B2 * | 2/2012 | Mo et al. | 313/113 |
| 8,214,061 | B2 * | 7/2012 | Westrick et al. | 700/9 |
| 2005/0024868 | A1 | 2/2005 | Nagai et al. | |
| 2005/0281030 | A1 | 12/2005 | Leong et al. | |
| 2006/0071614 | A1 | 4/2006 | Tripathi et al. | |
| 2006/0170373 | A1 | 8/2006 | Yang | |
| 2006/0197469 | A1 | 9/2006 | Kim | |
| 2007/0109813 | A1 | 5/2007 | Copeland et al. | |
| 2007/0286963 | A1 | 12/2007 | Rocha-Alvarez et al. | |
| 2008/0111804 | A1 | 5/2008 | Choi et al. | |
| 2009/0039788 | A1 | 2/2009 | Smith, III et al. | |
| 2010/0109557 | A1 | 5/2010 | Bouchard | |
| 2010/0290218 | A1 | 11/2010 | Yang et al. | |
| 2011/0012533 | A1 | 1/2011 | Lee | |

FOREIGN PATENT DOCUMENTS

| | | | |
|---|---|---|---|
| WO | 2010035062 | A1 | 4/2010 |
| WO | 2010137921 | A2 | 12/2010 |

OTHER PUBLICATIONS

International Application No. PCT/US2011/044854, Written Opinion, dated Nov. 7, 2011, 6 pages.

European Application No. 11810408.2 entitled "Light Engine Device with Direct to Linear System Driver"; Response dated Sep. 13, 2013 to European Communication dated Mar. 15, 2013; 4 pages.

* cited by examiner

0/0

-30/30

-45/45

-60/60

FIG. 10A
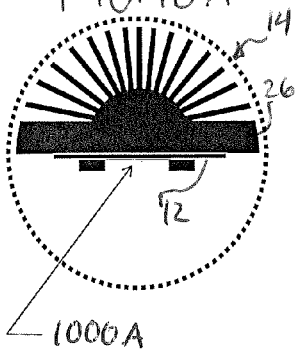
FIG. 10B
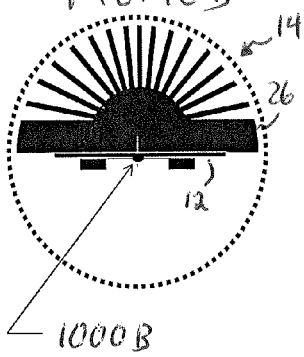
FIG. 10C
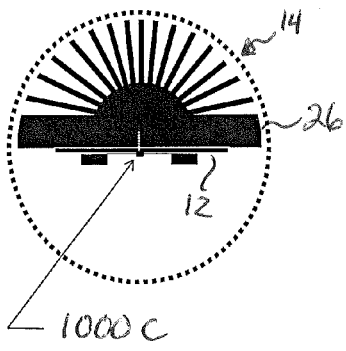
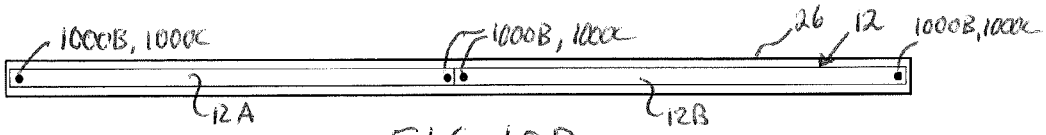
FIG. 10D
FIG. 11A
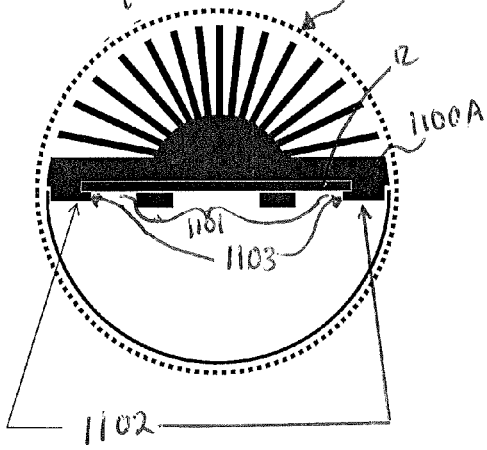
FIG. 11B
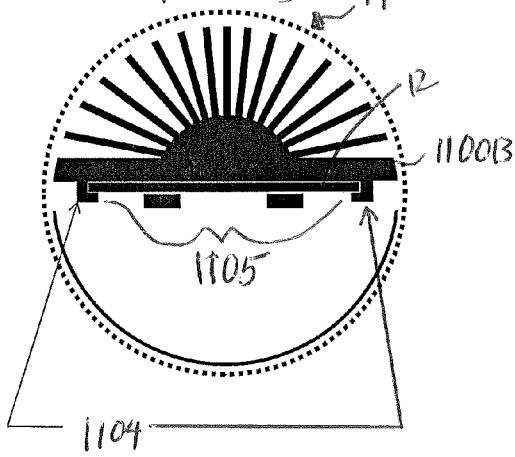
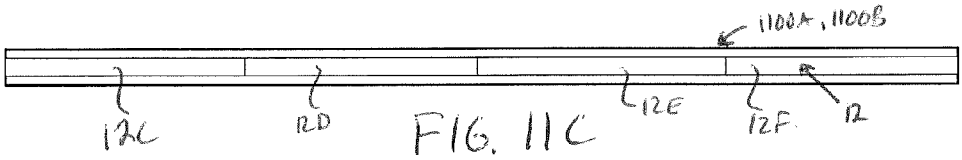
FIG. 11C

LIGHT ENGINE DEVICE WITH DIRECT TO LINEAR SYSTEM DRIVER

CROSS REFERENCE TO RELATED APPLICATION

The present application claims priority to U.S. Provisional Application No. 61/366,767, filed Jul. 22, 2010, the entire contents of which are incorporated herein by reference.

FIELD OF THE INVENTION

The present invention generally relates to light emitting diode (LED) lighting technology. Specifically, the present invention relates to a system of linear light engine devices utilizing independent and external power supplies for each linear device.

BACKGROUND OF THE INVENTION

Many offices and businesses utilize fluorescent lights to extensively illuminate large areas of buildings, thereby eliminating the need for using several small lights. However, traditional fluorescent lights are inefficient and may require great amounts of electrical energy to produce light. This is problematic, as large buildings may contain many fluorescent light fixtures that remain on for long periods of time, leading to a significant waste in energy. Plus, fluorescent fixtures have tombstone brackets, which carry the electrical circuit to power the fluorescent lights. These tombstones are vulnerable to arcing and restrict the ability to rotate the fluorescent lights, which would break the electrical circuit.

SUMMARY OF THE INVENTION

An embodiment of the present invention provides a light engine lighting device formed on a substrate and contained within a linear system. In an exemplary embodiment, the light engine lighting device is an LED linear device, also referred to herein as an "LED tube". The light engine lighting device is powered by an externally located, constant current power supply, which is electrically connected to a power terminal of the light engine lighting device via an opening in the linear system. In an exemplary embodiment, independent and external power supplies for each of the light engine lighting devices are used, thereby providing for rotational independence among each light engine lighting device.

A first aspect of an exemplary embodiment of the present invention provides a lighting system which includes a lighting device and a power supply driver. The lighting device includes a plurality of light-emitting elements and a power terminal. The power supply driver is electrically coupled to the power terminal to provide power to the plurality of light-emitting elements. The power supply driver is located external to the lighting device.

A second aspect of an exemplary embodiment of the present invention provides a lighting device which includes a substrate, a plurality of light-emitting elements coupled to the substrate, and a power terminal configured to be coupled to a power supply driver. The power supply driver is located external to the lighting device.

A third aspect of an exemplary embodiment of the present invention provides a lighting control system including at least one lighting system and at least one controller. The at least one lighting system has at least a first lighting device powered by a first power supply and a second lighting device powered by a second power supply. The at least one controller is coupled to the at least one lighting system for controlling operation of the first and second lighting devices.

BRIEF DESCRIPTION OF THE DRAWINGS

For the purpose of illustration, there are shown in the drawings certain embodiments of the present invention. In the drawings, like numerals indicate like elements throughout. It should be understood, however, that the invention is not limited to the precise arrangements, dimensions, and instruments shown. In the drawings:

FIGS. 10A-10D illustrate various means for securing the substrate to the heat sink of the lighting device of FIG. 1, in accordance with an exemplary embodiment of the present invention.

FIGS. 11A-11C illustrate alternative embodiments of the heat sink of the lighting device of FIG. 1, in accordance with an exemplary embodiment of the present invention.

DETAILED DESCRIPTION OF THE INVENTION

Various conventional LED lighting systems have been developed to increase efficiency over traditional fluorescent tubes. A drawback of such LED lighting systems is the excessive heat that is typically generated by the LEDs. Such heat causes the layers of phosphor within the LEDs to degrade. Furthermore, heat generated by power sources in close proximity to the LEDs melts the layers of phosphor and, as a result, changes the color emitted by the LEDs. The result after continuous degradation is that the LEDs emit light appearing as blue-white rather than the neutral or warm white emitted by non-degraded chips.

Color change occurs more dramatically in LEDs in close proximity to an internal or dependent power supply. As the diodes overheat they lose their ability to emit light. For example, LEDs disposed in a tube near an internal, dependent power supply may develop burn marks. These burn marks are seen as a drop off in output. For example, LEDs not degraded may output light at 300 foot-candles (fc), and LEDs in a damaged area may only output light at 150 fc at the edge of the burn zone and at 110 fc at the center of the burn zone.

The burn zone is typically at least as long as the length of the internal dependent power supply. Thus, the burn zone may be at least 4 to 5 inches long, or approximately 10% of an overall 48-inch tube. Given that these losses can occur inside of a single year of non-stop operation, the lifetime for these LED lighting systems is significantly compromised, resulting in increased energy consumption and higher costs.

An exemplary embodiment of the present invention provides a lighting system comprising one or more lighting devices, each comprising one or more light-emitting elements mounted onto a substrate mounted within the lighting device. Each light-emitting element is powered by an externally located, constant current power supply, which is directly connected to the light-emitting element via a power terminal. In an exemplary alternative embodiment, the lighting system is mounted within a fixture and comprises a plurality of lighting devices and a plurality of independent power supplies, each of which is connected to a respective one of the plurality of lighting devices. As a result, each lighting device is independently powered for providing independent, configurable lighting. In such exemplary alternative embodiment, each lighting device may be rotatably mounted within the fixture and configured for complete rotational independence, thereby providing a variety of configurable lighting conditions.

Exemplary applications of the lighting system include offices, homes, parking garages, etc., which applications are designed to provide buildings with an alternative lighting arrangement to less efficient fluorescent tube lighting. Exemplary light-emitting elements in the exemplary embodiments of the present invention described here include LEDs, light emitting capacitors (LECs), and organic LEDs (OLEDs).

Figure 1:
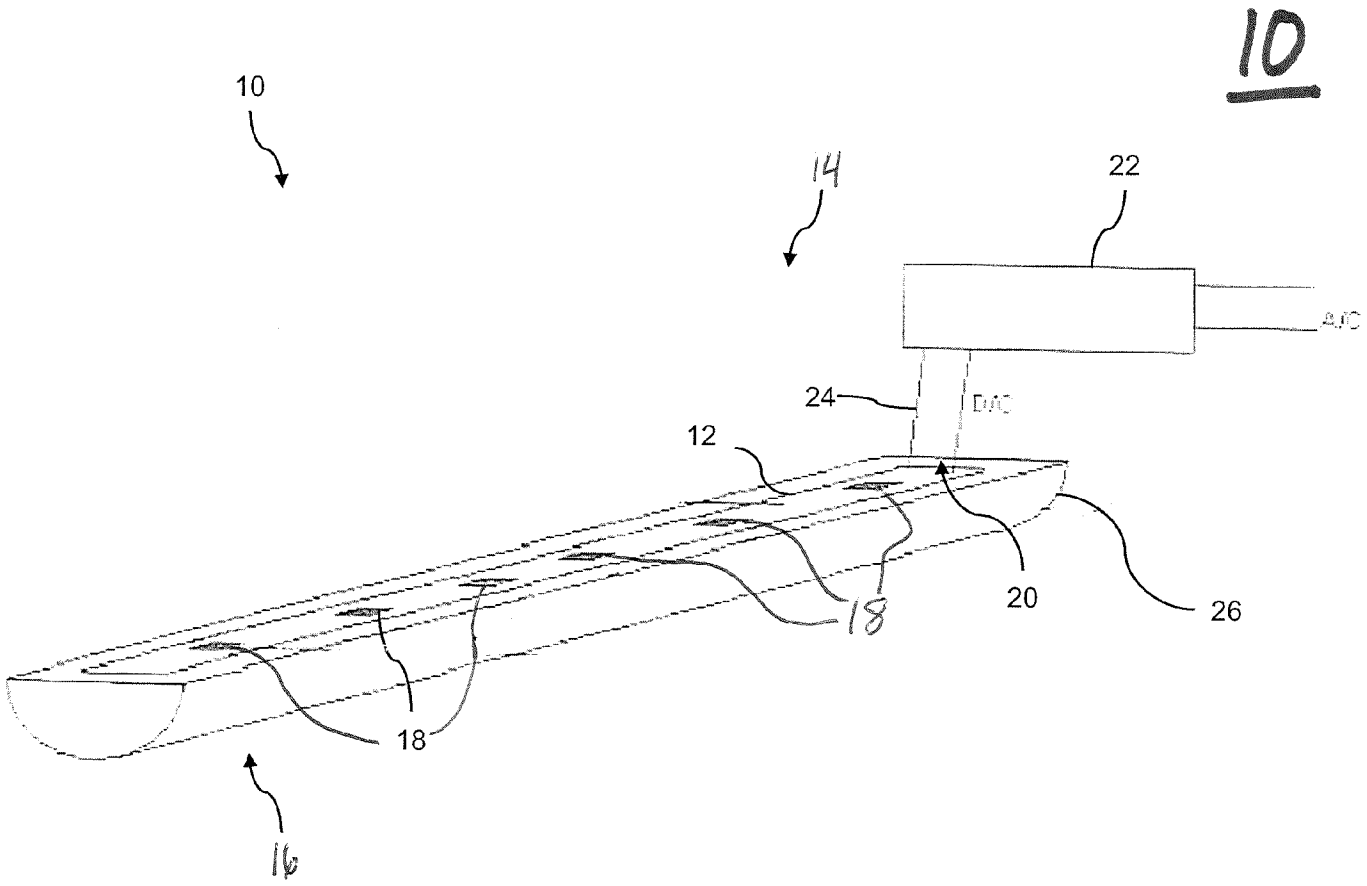
FIG. 1 depicts a side perspective view of an exemplary embodiment of a lighting system comprising one lighting device comprising a heat sink and a substrate having one or more light-emitting elements, in accordance with an exemplary embodiment of the present invention.

Referring now to FIG. 1, there is illustrated a lighting system 10, in accordance with an exemplary embodiment of the present invention. As depicted, the lighting system 10 comprises a lighting device 14 which comprises a linear substrate 12. The lighting device 14 further comprises a plurality of light-emitting elements 18 and a power terminal 20 coupled to the plurality of light-emitting elements 18. The light-emitting elements 18 are disposed in a linear relationship along the substrate 12.

In the exemplary embodiment illustrated in FIG. 1, the lighting device 14 is a linear device or system 16 as the substrate 12 is linear and the light-emitting elements 18 are disposed along the substrate 12 linearly. As will be discussed below, the lighting device 14 is so configured so that it may be dropped into existing fluorescent-tube lighting fixtures without adapters or, optionally, with rotational end caps, as described below. It is to be understood, however, that the lighting device 14 is not limited to being a linear device 16. Other geometric configurations are contemplated, such as circular or toroid, U-shaped, etc.

Continuing with FIG. 1, the system 10 further comprises a power supply driver 22 electrically connected to the power terminal 20 by a set of wires 24. The power supply driver 22 converts A/C line electricity to D/C electricity and delivers the D/C electricity to the light-emitting elements 18 via the wires 24. The wires 24 protrude through an opening in the lighting device 14 for connecting the power supply driver 22 to the power terminal 20. In an exemplary embodiment of the system 10, the power supply driver 22 is located external to the lighting device 14. By being so disposed, heat from the power supply driver 22 is isolated from the lighting device 14 and, therefore, burn marks on the lighting device 14 are minimized. It is to be understood that other embodiments in which the power supply driver 22 is located inside the lighting device 14 are contemplated.

The system 10 additionally comprises a heat sink 26 for removing heat from the lighting device 14. The heat sink 26 may comprise a linear thermal management heat sink of any material type or configuration for passive or active cooling. For example, the heat sink 26 may primarily be a flat plate, die-cast finned type, or extruded finned type. Materials used to form the heat sink 26 may include aluminum, copper, and some other types of materials with sufficient heat conductivity.

Figure 2:
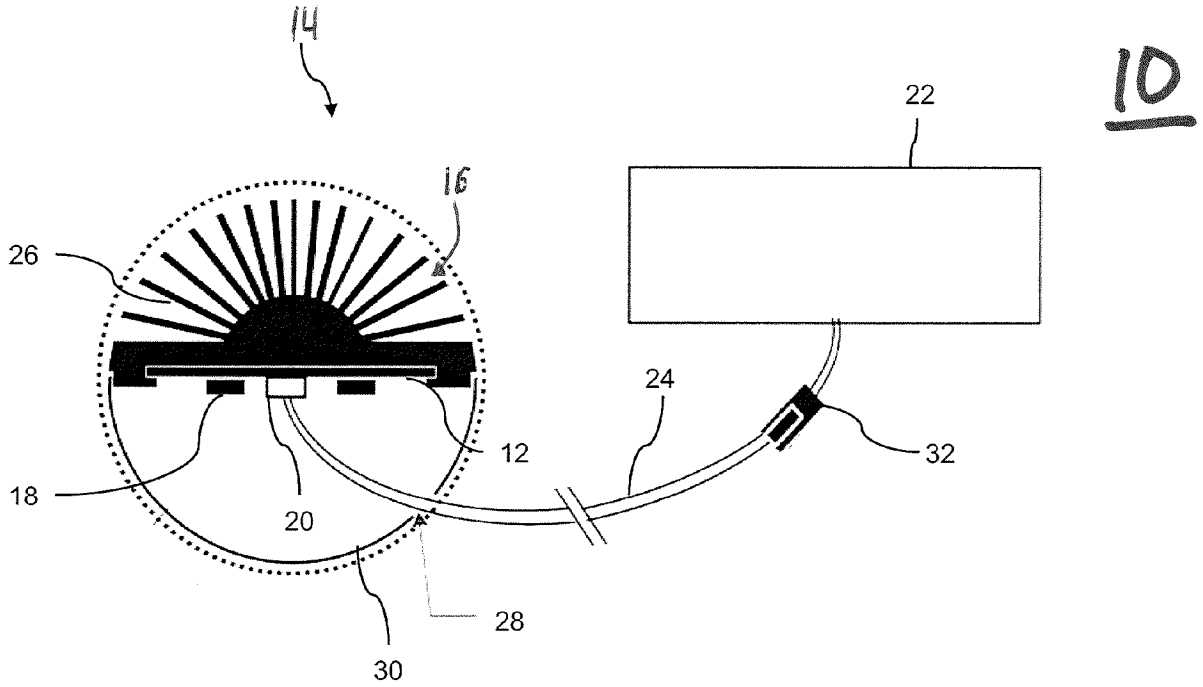
FIG. 2 depicts a cross-sectional view of the lighting system of FIG. 1, in accordance with an exemplary embodiment of the present invention.

In accordance with an exemplary embodiment of the present invention, the heat sink 26 may comprises a plurality of radially extending fins, the outer periphery of which form a semi-circular shape in cross section, as illustrated in FIG. 2. Other embodiments of the heat sink 26, including ones including linearly extending fins, are contemplated.

Various embodiments of the light-emitting elements 18 are contemplated. In an exemplary embodiment, each light-emitting element 18 is an LED. Such LEDs may be discrete components packaged in conventional 5 mm epoxy cylindrical packages, or they may be surface-mounted packaged dies or bare (unpackaged) dies. It is contemplated, however, that the light-emitting elements are not limited to being LEDs. Alternative embodiments in which the light-emitting elements 18 are light emitting capacitors (LECs) or organic LEDs are contemplated.

In an exemplary embodiment, the substrate 12 is a board and the light-emitting elements 18 are bare (unpackaged) dies mounted on the board and wire bonded. Alternative embodiments in which the substrate 12 is a flex substrate laminated with flex circuitry are contemplated. It is to be understood that each component of the lighting device 14 can be manufactured in various lengths and dimensions as necessary to allow the lighting device 14 to fit into a conventional lighting fixture, e.g., a fluorescent tube fixture.

Referring now to FIG. 2, there is illustrated a cross-sectional view of the lighting device 14, in accordance with an exemplary embodiment of the present invention. As illustrated, the lighting device 14 further comprises a lens 30 which covers and protects the substrate 12 and the light-emitting elements 18 disposed thereon. The lens 30 is not illustrated in FIG. 1 to provide a clearer view of the substrate 12 and the light-emitting elements 18 disposed thereon.

The cross-sectional view illustrated in FIG. 2 shows the wiring connection 24 between the lighting device 14 and the power supply driver 22. As shown, the wiring 24 connects to the power terminal 20 of the lighting device 14 through an opening 28 in the lens 30. Other embodiments of the path of the wiring 24 are contemplated. For example, it is contemplated that the wiring 24 may alternatively protrude through an opening in the heat sink 26 or through an opening in a rotational device (illustrated in FIG. 5) secured to an end of the lighting device 14. In an exemplary embodiment, the power supply driver 22 comprises a fastener 32 for removable connection to the wiring 24. The fastener 32 allows the power supply driver 22 to be removed and replaced for easier installation and/or repair.

Exemplary applications of the lighting device 14 include use as a retrofit replacement to a conventional fluorescent tube system. Typically, a fluorescent tube system comprises one or more fluorescent tubes, each of which is mounted in a fixture between a pair of tombstone assemblies. Each tombstone assembly includes a socket bar, a lamp holder, and at least some wiring. The power supplied to each tombstone assembly is delivered through fixture wiring that extends from a ballast. The ballast is, generally, a transformer that receives power from supply wires that extend from an A/C power supply that is protected by either a fuse or circuit breaker.

Retrofitting the conventional fluorescent tube system is now described with respect to the system 10. During a retrofit replacement using the lighting system 10, the power supply driver 22 may be installed in the area allocated for the ballast of the fluorescent tube system. Once installed, the wiring 24 is connected to the fastener 32 of the power supply driver 22 and to the power terminal 20 of the lighting device 14. The lighting device 14 is then inserted between the tombstones in the conventional fluorescent tube fixture, and the lighting device 14 is then ready for use. The lighting device 14 may be fitted with non-rotating end caps for securing the lighting device 14 between the tombstones of the conventional fluorescent tube system or, alternatively, may be fitted with a rotational device for securing the lighting device 14 between the tombstones, as described below. In such embodiments, the tombstones of conventional fluorescent tube system hold the lighting device 14 in place but do not supply electrical power as electrical power is separately supplied by the wiring 24 connected to the power supply driver 22.

Figure 3:
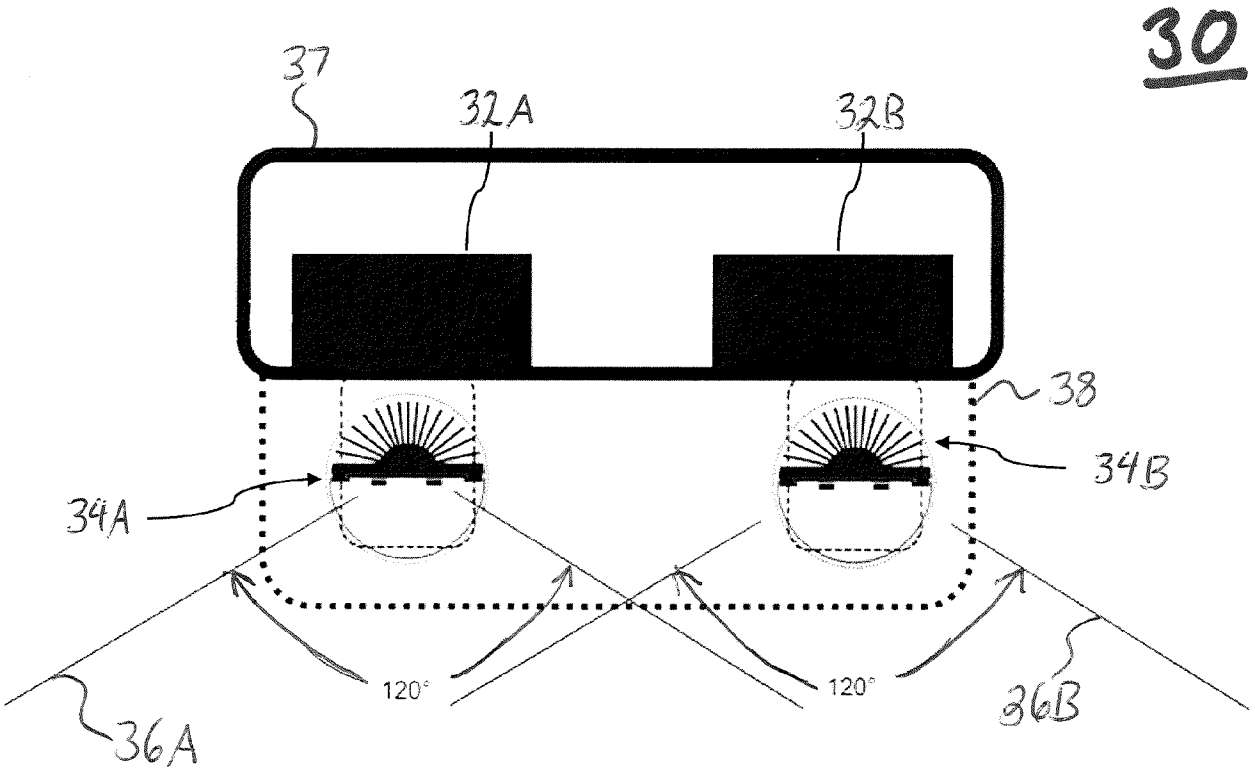
FIG. 3 depicts a cross-sectional view of another exemplary embodiment of a lighting system comprising a plurality of lighting devices, each casting a light cone, in accordance with an exemplary embodiment of the present invention.

Referring now to FIG. 3, there is illustrated another exemplary embodiment of the lighting system 10, generally designated as 30 in FIG. 3, in accordance with an exemplary embodiment of the present invention. Whereas the lighting system 10 illustrated in FIGS. 1 and 2 is shown having one lighting device 14, FIG. 3 illustrates the lighting system 30 having two lighting devices 14, designated as 34A and 34B in FIG. 3. It is to be understood that further embodiments of the lighting systems 10 and 30 having more than two lighting devices are contemplated.

Each of the lighting devices 34A and 34B is mounted to a lighting fixture 37, which contains two power supplies 32A and 32B. An optional transparent fixture cover 38 may cover the lighting devices 34A and 34B to protect them or to diffuse or beam-shape light projected by the lighting devices 34A and 34B.

The lighting system 30 further comprises two power supplies 32A and 32B, each of which is connected to the lighting devices 34A and 34B, respectively, in a manner similar to the connection of the lighting device 10 to its power supply 22. As each lighting device 34A and 34B is independently powered by a separate power supply 32A, 32B, the lighting system 30 may be customized in terms of color and wattage and, in an exemplary embodiment, angle/position, etc. Although the system 30 includes two power supplies 32A and 32B, it is to be understood that alternative embodiments of the system 30 including more than two power supplies 32A and 32B powering more than two lighting devices 34A and 34B are contemplated.

In the configuration illustrated in FIG. 3, the independently powered lighting devices 34A and 34B are positioned to direct light downward in respective light cones 36A and 36B. Exemplary light cones 36A and 36B may project light over 120°. Such light distribution may be beneficial within parking garage structures for task areas such as pay stations or landings were most pedestrian traffic occurs, for example.

Since each lighting device 34A, 34B is not reliant upon the electrical charge supplied from a tombstone-style fixture, each lighting device 34A, 34B may be independently controlled. For example, each lighting device 34A, 34B may operate at a different wattage, use different colored LEDs (i.e. RGB systems) or be independently rotated, if so configured. FIG. 3 illustrates the lighting devices 34A and 34B positioned with 0° of rotation so that the light cones 36A and 36B are directed straight down (assuming the lighting fixture 37 is mounted within a ceiling).

Figure 4:
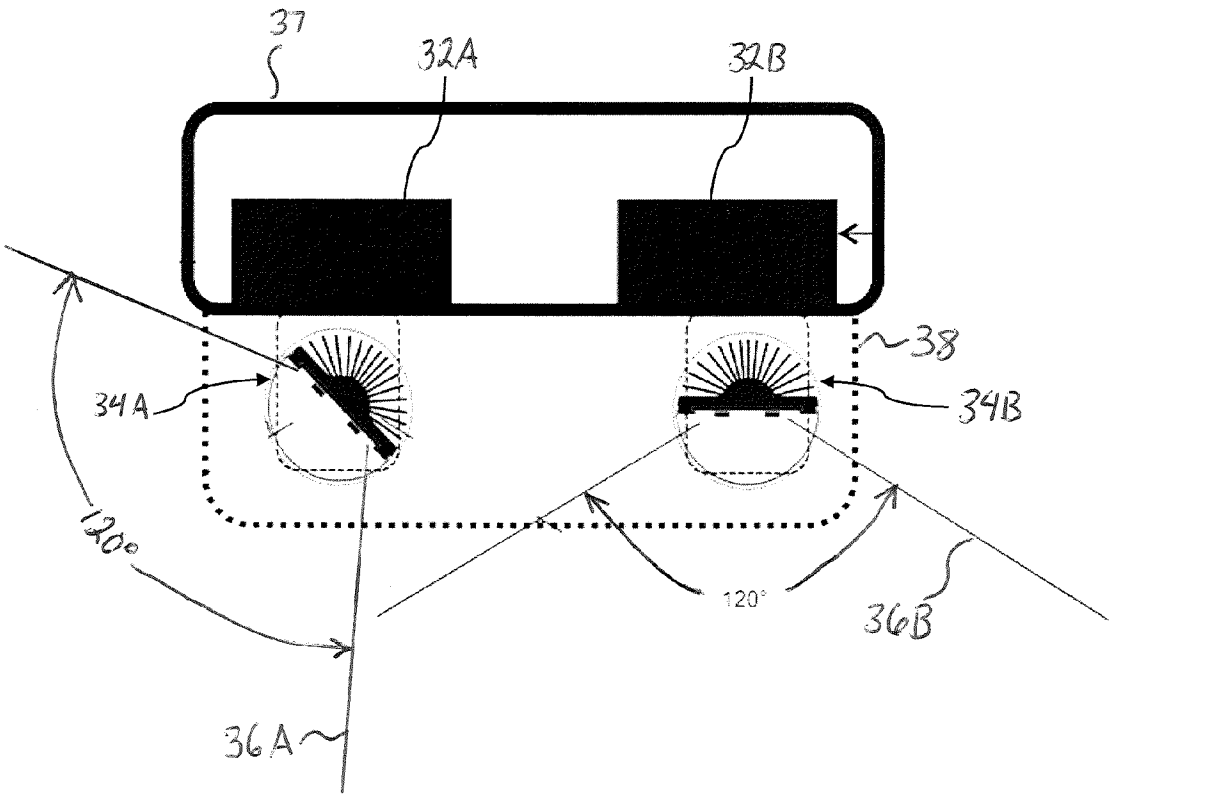
FIG. 4 depicts a cross-sectional view of the lighting system of FIG. 3 in which one of the lighting devices is rotated to rotate the light cone projected by the rotated lighting device, in accordance with an exemplary embodiment of the present invention.

In an exemplary embodiment, each lighting device 34A, 34B may be rotated independently, as shown in FIG. 4. In the view of the system 30 illustrated in FIG. 4, the lighting device 34B is positioned with 0° of rotation and continues to project the light cone 36B straight down. The lighting device 34A, on the other hand, has been rotated toward the side. The angle of the lighting device 34A assists in increasing the area of coverage by the combined cones 36A and 36B of light across an interior space being illuminated. Meanwhile, the position of the lighting device 34B may assist in reducing light pollution. For example, if the lighting devices 34A and 34B are installed in a parking garage structure, the rotation of the lighting device 34A may help to even the light distribution of the combined cones 36A and 36B and reduce areas of over illumination directly under the fixture 37. At the same time, the position of the cone 36B may assist in reduction of light cast at an outside edge of the parking garage structure.

As a further example, in a four-device system, the two center lighting devices could be set straight down, while the outside devices could rotated outwardly by 30° to wash more light across an area, such as a room, to be illuminated. It is to be appreciated that many other configurations are possible within the scope of the invention.

Figure 8A:
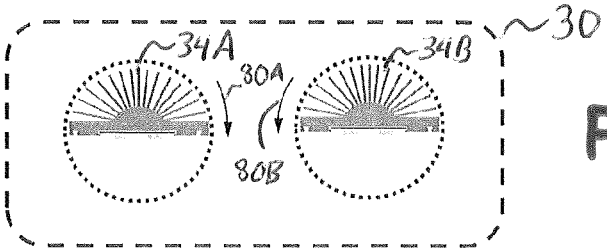
FIGS. 8A-8D illustrate various rotational positions of the lighting devices of the lighting system of FIG. 3, in accordance with an exemplary embodiment of the present invention.

Referring now to FIGS. 8A-8D, there are illustrated four exemplary rotational arrangements of the lighting devices 34A and 34B in the system 30, in accordance with an exemplary embodiment of the present invention. In FIG. 8A, there is illustrated a first rotational arrangement in which the lighting devices 34A and 34B are rotated by 0°. In this position, most of the light emitted by the lighting devices 34A and 34B is projected downwardly.

Figure 8B:
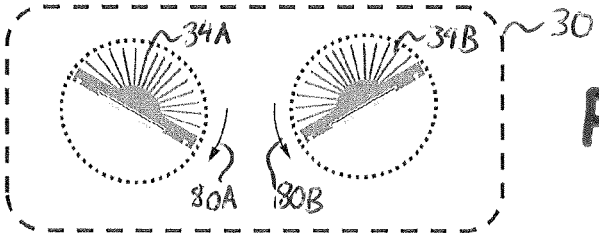

In FIG. 8B, there is illustrated a second rotational arrangement in which the lighting device 34A has been rotated by 30° in a direction 80A, and the lighting device 34B has been rotated by 30° in a direction 80B. In an absolute scale, the lighting device 34A has been rotated by −30°, and the lighting device 34B has been rotated by 30°. In this position, the light emitted by the lighting devices 34A and 34B is projected downwardly and partially outwardly.

Figure 8C:
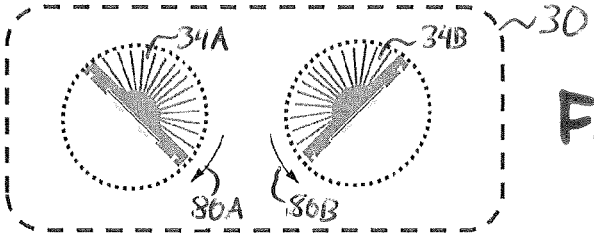

In FIG. 8C, there is illustrated a third rotational arrangement in which the lighting device 34A has been rotated by 45° in the direction 80A, and the lighting device 34B has been rotated by 45° in the direction 80B. In an absolute scale, the lighting device 34A has been rotated by −45°, and the lighting device 34B has been rotated by 45°. In this position, the light emitted by the lighting devices 34A and 34B is balanced between being projected downwardly and outwardly.

Figure 8D:
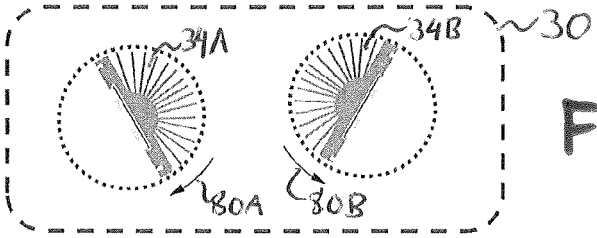

In FIG. 8D, there is illustrated a fourth rotational arrangement in which the lighting device 34A has been rotated by 60° in the direction 80A, and the lighting device 34B has been rotated by 60° in the direction 80B. In an absolute scale, the lighting device 34A has been rotated by −60°, and the lighting device 34B has been rotated by 60°. In this position, the light emitted by the lighting devices 34A and 34B is projected outwardly and partially downwardly.

In an exemplary embodiment, the lighting devices 34A and 34B are configured for rotation through 360°. Referring now to FIGS. 9A-9D, there are illustrated four further exemplary rotational arrangements of the lighting devices 34A and 34B. As shown in the embodiment of the lighting system 30 illustrated in FIGS. 9A-9D, the lighting system 30 may be configured with a reflector 95 for reflecting light projected by the lighting devices 34A and 34B when rotated into a position for projecting light upwardly. When fitted with the reflector 95, the lighting system 30 may be used to provide indirect light.

Figure 9A:
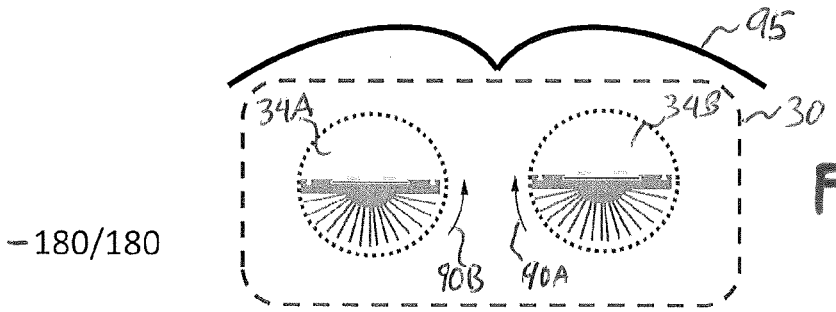
FIGS. 9A-9D illustrate various additional rotational positions of the lighting devices of the lighting system of FIG. 3 equipped with a reflector, in accordance with an exemplary embodiment of the present invention.

In FIG. 9A, there is illustrated a first rotational arrangement in which the lighting devices 34A and 34B are rotated by −180° and 180°, respectively. In this position, most of the light emitted by the lighting devices 34A and 34B is projected upwardly and reflected by the reflector 95.

Figure 9B:
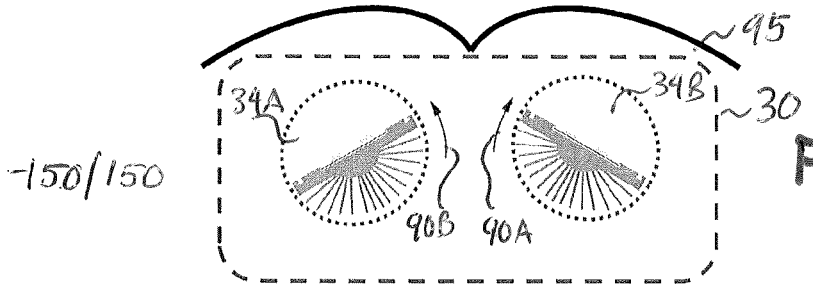

In FIG. 9B, there is illustrated a second rotational arrangement in which the lighting device 34A has been rotated by 30° in a direction 90B, and the lighting device 34B has been rotated by 30° in a direction 90A relative to FIG. 9A. In an absolute scale, the lighting device 34A has been rotated by −150°, and the lighting device 34B has been rotated by 150°. In this position, the light emitted by the lighting devices 34A and 34B is projected upwardly and partially outwardly.

Figure 9C:
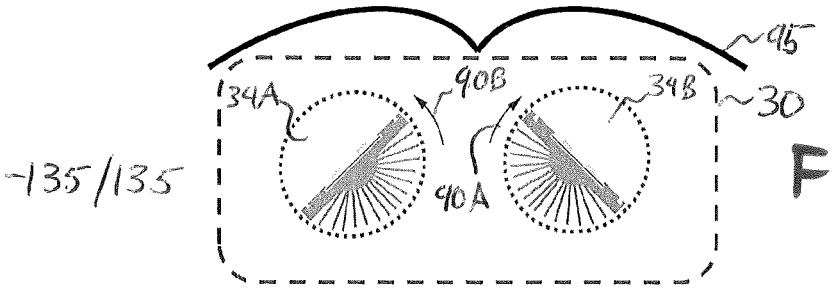

In FIG. 9C, there is illustrated a third rotational arrangement in which the lighting device 34A has been rotated by 45° in the direction 90B, and the lighting device 34B has been rotated by 45° in the direction 90A relative to FIG. 9A. In an absolute scale, the lighting device 34A has been rotated by −135°, and the lighting device 34B has been rotated by 135°. In this position, the light emitted by the lighting devices 34A and 34B is balanced between being projected upwardly and outwardly.

Figure 9D:
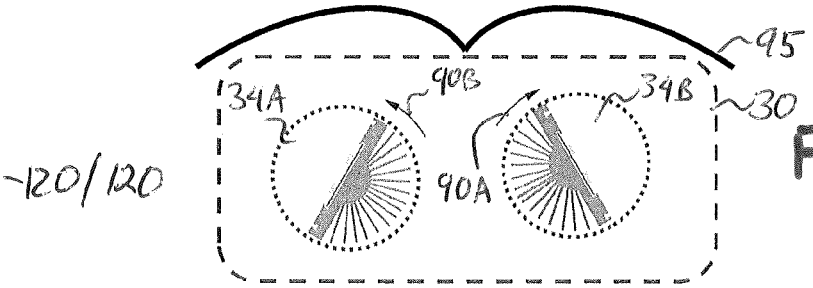

In FIG. 9D, there is illustrated a fourth rotational arrangement in which the lighting device 34A has been rotated by 60° in the direction 90B, and the lighting device 34B has been rotated by 60° in the direction 90A relative to FIG. 9A. In an absolute scale, the lighting device 34A has been rotated by −120°, and the lighting device 34B has been rotated by 120°. In this position, the light emitted by the lighting devices 34A and 34B is projected outwardly and partially downwardly.

Figure 5:
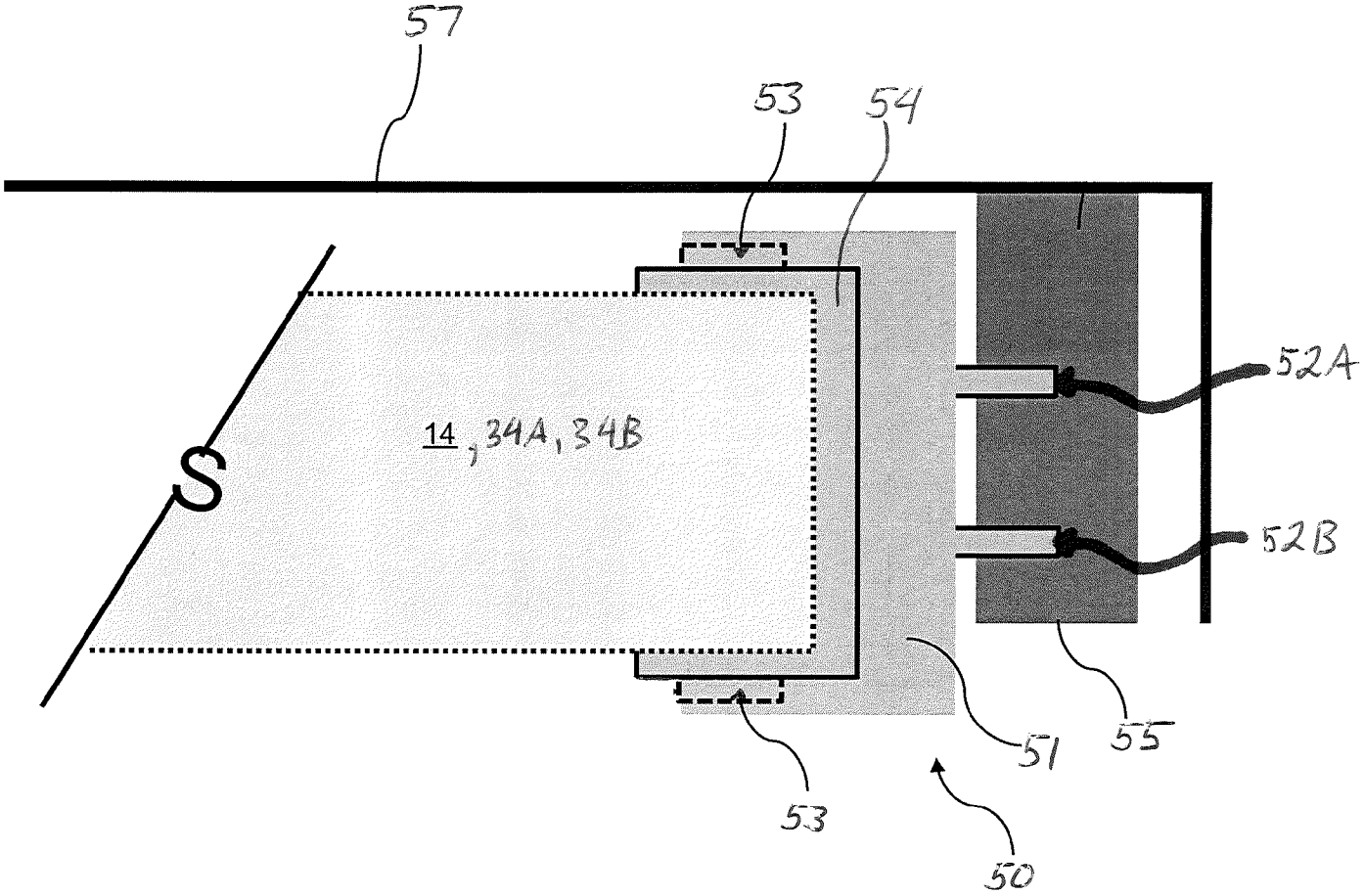
FIG. 5 depicts a side view of rotational device configured to connect the light device of FIG. 1 to a conventional fluorescent tube fixture, in accordance with an exemplary embodiment of the present invention.
Figure 6:
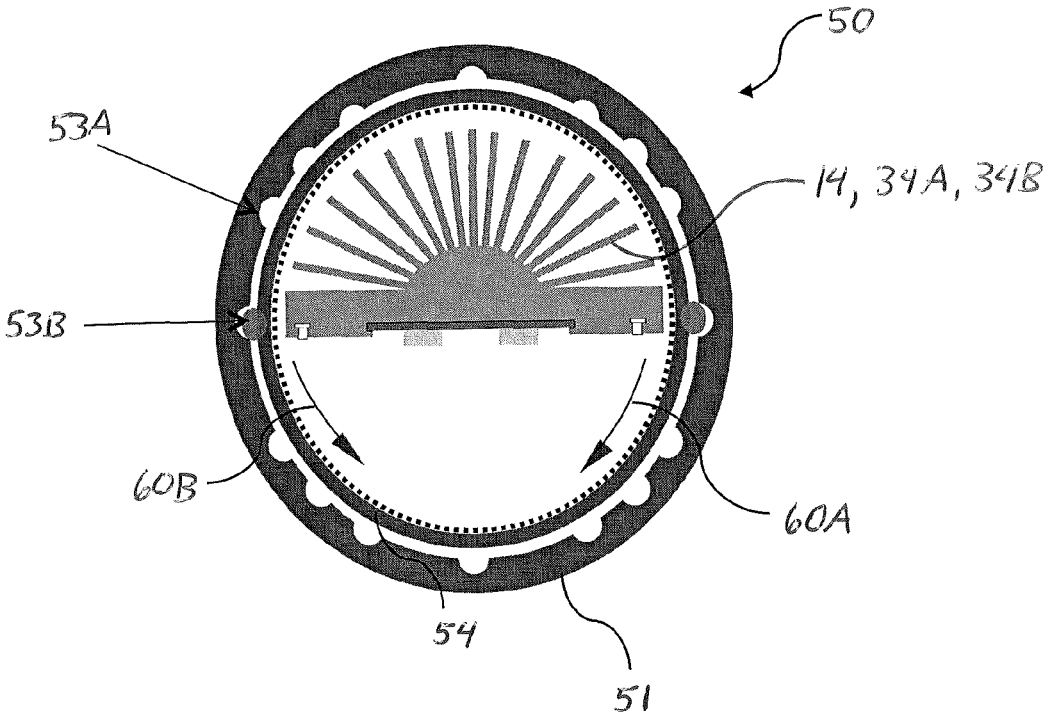
FIG. 6 depicts a cross-sectional view of the rotational device of FIG. 5, in accordance with an exemplary embodiment of the present invention.

As described above, in one exemplary embodiment, the lighting device 14 (and the lighting devices 34A and 34B) is configured to be drop-fitted into the tombstones of a conventional fluorescent-tube lighting fixture. In another exemplary embodiment, a rotational device (rotatable end cap) is mounted to each end of the lighting device 14 (and the lighting devices 34A and 34B), and this assembly is mounted into the lighting fixture. Referring now to FIGS. 5 and 6, there is illustrated a rotational device, generally designated as 50, in accordance with an exemplary embodiment of the present invention. The rotational device 50 is configured allow for rotation of the lighting device 14, 34A, or 34B around a central axis of the lighting device 14, 34A, 34B.

As shown in FIG. 5, the rotational device 50 comprises a fixed housing component 51 and a rotatable housing component 54 disposed within the fixed housing component 51. The fixed housing component 51 comprises a pair of prongs 52A and 52B which are configured for insertion into a support assembly 55 (e.g., a tombstone bracket) mounted to a conventional fluorescent-tube light fixture 57. The rotatable housing component 54 is securely mounted to the lighting device 14, 34A, 34B and is rotatably mounted within the fixed housing component 51. The rotational device 50 comprises a fastener 53 for rotatably locking the rotatable housing component 54 relative to the fixed housing component 51.

As shown in FIG. 6, the rotatable housing component 54 is configured to rotate relative to fixed housing component 51 to rotate the lighting device 14, 34A, 34B in a first rotational direction 60A and a second rotational direction 60B. The fastener 53 comprises a plurality of notches 53A on an inner surface of the fixed housing component 51 and a plurality of opposing protrusions 53B on an outer surface of the rotatable housing component 54. The plurality of opposing protrusions 53B is configured to snap into respective ones of the plurality of notches 53A and to be snapped out of such notches 53A when sufficient torque is applied to the rotational device 50. In the exemplary embodiment illustrated in FIG. 6, the rotational device 50 comprises 16 notches 53A and two protrusions 53B. This arrangement allows for 16 angular positions of the lighting device 14, 34A, 34B.

It is to be understood that other embodiments in which the notches 53A are located on the outer surface of the rotatable housing component 54 and the protrusions 53B are located on the inner surface of the fixed housing component 51. Additionally, it is contemplated in other embodiments that the fixed housing component 51 is disposed within the rotatable housing component 54 and that the fastener 53 comprises notches or protrusions on the outer surface of the fixed housing component 51 and protrusions or notches, respectively, on the inner surface of the rotatable housing component 54.

The rotational device 50 allows the lighting device 14, 34A, 34B to be retrofit to existing lighting fixtures containing, e.g., a tombstone bracket 55, while allowing rotational movement of each lighting device 14, 34A, 34B. In an exemplary embodiment, both fixed housing component 51 and rotatable housing component 54 are generally cylindrical in shape to maintain the cylindrical profile of the lighting device 14, 34A, 34B when inserted within a conventional fluorescent lighting fixture. However, it will be appreciated that the rotational device 50 represents one possible configuration for rotating and securing each lighting device 14, 34A, 34B, and that many other embodiments are possible within the scope of the invention.

Figure 5A:
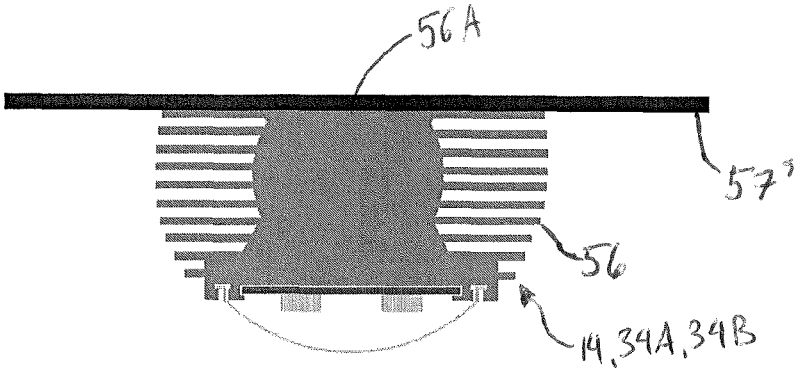
FIG. 5A depicts an exemplary fixture for mounting the lighting systems of FIGS. 1 and 3, in accordance with an exemplary embodiment of the present invention.

FIG. 5A illustrates an alternative exemplary embodiment of a fixture for mounting the lighting devices 14, 34A, and 34B, in accordance with an exemplary embodiment of the present invention. In this embodiment, the heat sink of the lighting device 14, 34A, 34B is modified so that the fins extend in a horizontal orientation. The resulting heat sink, generally designated in FIG. 5A as 56, comprises a flat planar top surface 56A for being placed in contact with and secured directly to a mounting surface 57' of a fixture. An exemplary embodiment of the mounting surface 57' is in a lighting fixture, such as the lighting fixture 37.

Figure 7:
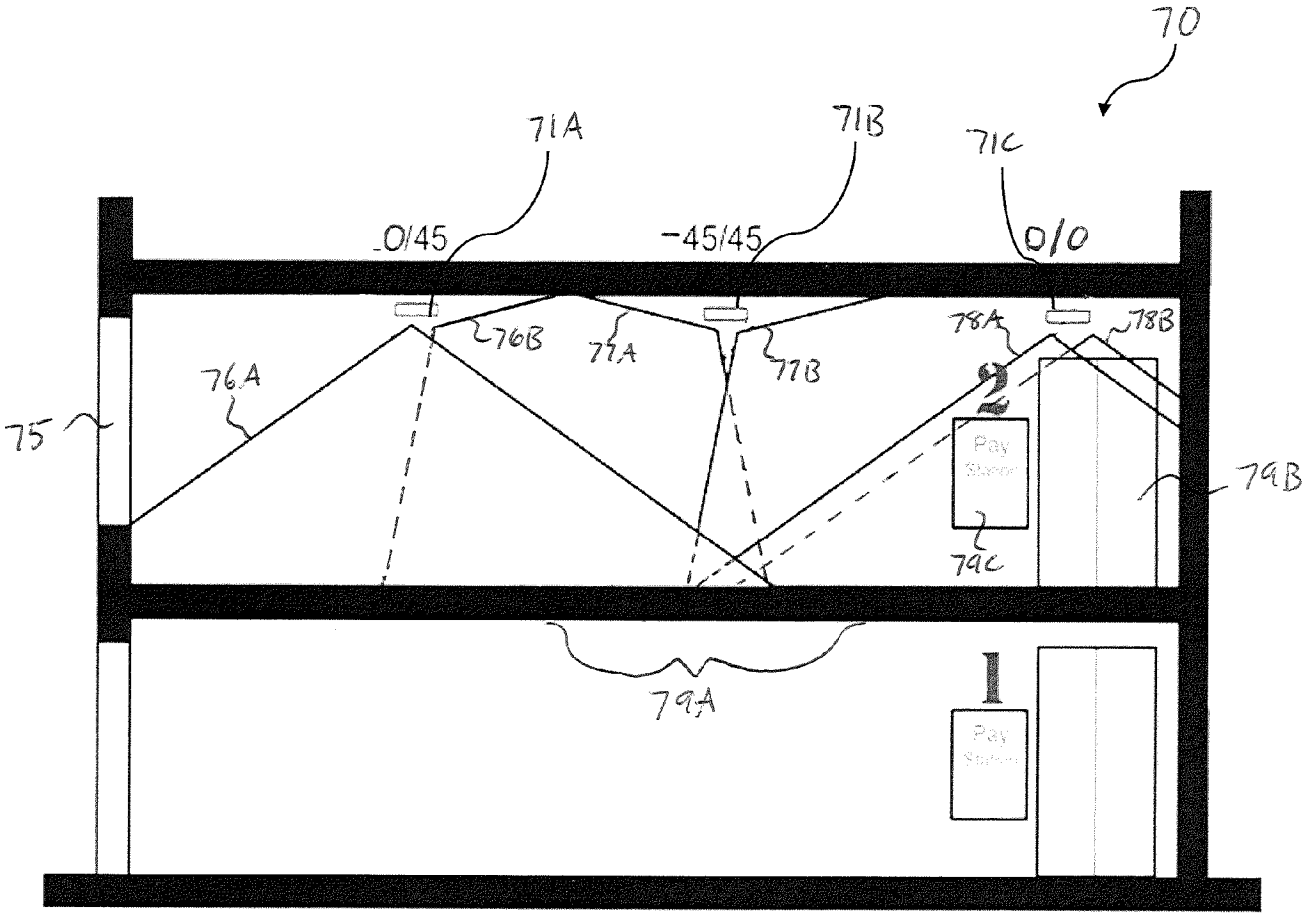
FIG. 7 depicts a cross-sectional view of a plurality of lighting devices installed in an exemplary parking structure, in accordance with an exemplary embodiment of the present invention.

FIG. 7 shows an exemplary application of the lighting system 30, in accordance with an exemplary embodiment of the invention. As shown, three lighting systems 30, generally designated as 71A, 71B, and 71C in FIG. 7, are installed within a structure 70, e.g., a, parking garage. In the exemplary embodiment illustrated in FIG. 7, each lighting system 71A-C includes two lighting devices. Each of these lighting devices may have different levels of brightness and beam angles, potentially asymmetric. Upon illumination, the lighting system 71A projects light cones 76A and 76B; the lighting system 71B projects light cones 77A and 77B; and the lighting system 71C projects light cones 78A and 78B. Any combination of the light cones 76A-B, 77A-B, and 78A-B may overlap with one another.

In the exemplary embodiment illustrated in FIG. 7, one lighting device in the lighting system 71A is rotated at 0° and the other is rotated at 45°; one lighting device in the lighting system 71B is rotated at −45° and the other is rotated at 45°; and both lighting devices in the lighting system 71C are rotated at 0°. The arrangement of the lighting devices in FIG. 7 is configured to reduce light pollution at a perimeter of the parking garage 70. Specifically, the light cone 76A is pointed so that it doesn't pass through opening 75 in the parking garage 70. The lighting devices of the lighting system 71B are set to −45°/45°, respectively, to provide a wide spread of illumination in a central portion 79A of the parking garage 70. The lighting devices of the lighting system 71C are not rotated to provide focused light on an elevator landing 79B, a pay station 79C, etc. Again, it is to be appreciated that a wide variety of lighting configurations are possible to address any number of lighting conditions by utilizing independent and external power supplies for each lighting device in the lighting systems 71A, 71B, and 71C.

Referring now to FIGS. 10A-10D, there are illustrated cross-sectional views of the lighting device 14 showing various means for securing the substrate 12 to the heat sink 26 of the lighting device 14 of FIG. 1, in accordance with an exemplary embodiment of the present invention. In FIG. 10A, the means for securing the substrate 12 to the heat sink 26 is an adhesive 1000A between the substrate 12 and the heat sink 26. In FIG. 10B, the means for securing the substrate 12 to the heat sink 26 is one or more screws 1000B. In FIG. 10C, the means for securing the substrate 12 to the heat sink 26 is one or more rivets 1000C. FIG. 10D illustrates a plan view of the substrate 12 showing the attachment means 1000B or 1000C in place along the substrate 12.

In an exemplary embodiment, the substrate 12 may be formed as one piece, which is secured to the heat sink 26 by means 1000B or 1000C at opposite ends of the substrate 12. In another exemplary embodiment, the substrate 12 may be formed as two or more pieces. FIG. 10D illustrates an exemplary embodiment in which the substrate 12 is formed as two pieces 12A and 12B, the ends of each of which are secured by attachment means 1000B or 1000C to the heat sink 26. The substrate 12 may be formed as more than one piece, depending on the length of the lighting device 14, 34A, or 34B, to assist in manufacturing or assembly.

Additional means for attaching the substrate 12 to the heat sink 26 are contemplated. Illustrated in FIGS. 11A and 11B are alternative embodiments of the heat sink 26, respectively designated as 1100A and 1100B, in accordance with an exemplary embodiment of the present invention. The heat sink 1100A comprises a shallow slot 1101 flanked on either side by a wall 1102 having a lip 1103. The walls 1102 and lips 1103 on either side of the slot 1101 provide for a friction fit for the substrate 12. The heat sink 1100B comprises a pair of opposing L-shaped arms 1104 which form a slot 1105 which holds the substrate 12. The slot 1105 provides for a friction fit to hold the substrate 12 in place.

FIG. 11C provides a bottom plan view of the heat sinks 1100A and 1100B holding the substrate 12. In an exemplary embodiment, the substrate 12 is slide into place through the slot 1101 or 1105. Because of the friction fit, it is desirable to form the substrate 12 from separate pieces, which are each then slide into place in the groove 1101 or 1105. The number of pieces from which the substrate 12 is formed may depend on the length of the lighting device 14. For example, if the lighting device 14 is about 48 inches long, the substrate 12 may be formed from four pieces 12C-F of about 11.625 inches in length.

Figure 12A:
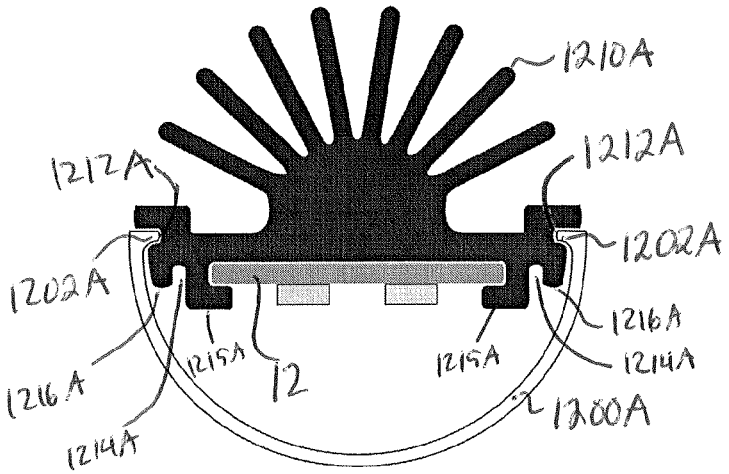
FIGS. 12A-12C illustrate various embodiments of a lens configured for covering the one or more light-emitting elements of the lighting device of FIG. 1, in accordance with an exemplary embodiment of the present invention.

Various options for mounting the lens 30 to the heat sink 26 are now discussed. FIG. 12A illustrates a first option for mounting the lens to the heat sink. In FIG. 12A, an alternative embodiment of the lens 30 is designated as 1200A and an alternative embodiment of the heat sink 26 is designated as 1210A. The lens 1200A includes a pair of opposing, inwardly projecting ridges 1202A, and the heat sink 1210A includes a pair of inwardly set grooves 1212A. The ridges 1202A are configured to be snapped into the grooves 1212A to secure the lens 1200A to the heat sink 1210A. The heat sink 1210A comprises a pair of inwardly facing L-shaped brackets 1215A to hold the substrate 12 in a friction fit.

Figure 12B:
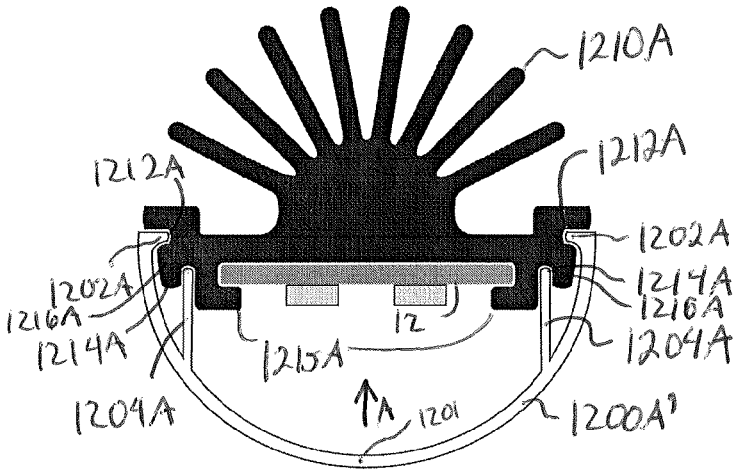

FIG. 12B illustrates a second option for mounting the lens to the heat sink. In FIG. 12B, an alternative embodiment of the lens 30 is designated as 1200A' and the alternative embodiment of the heat sink 26 is designated as 1210A, the same as that illustrated in FIG. 12A. The lens 1200A' includes the pair of opposing, inwardly projecting ridges 1202A and additionally a pair of upwardly projecting thin ridges 1204A. The heat sink 1210A includes the pair of inwardly set grooves 1212A to receive the ridges 1202A. It additionally includes a pair of protrusions 1216A which form a pair of grooves 1214A for receiving the thin ridges 1204A. The thin ridges 1204A snap into the grooves 1214A to prevent the lens 1200A' from disengaging from the heat sink 1210A if the bottom 1201 of the lens is deformed in a direction A illustrated in FIG. 12B.

Figure 12C:
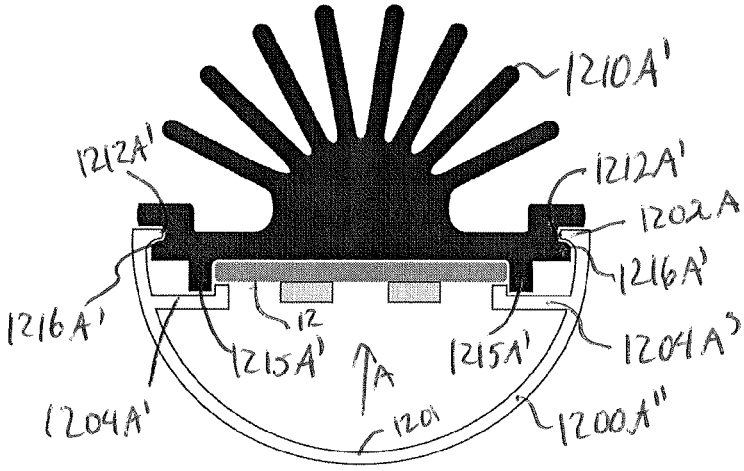

FIG. 12C illustrates a third option for mounting the lens to the heat sink. In FIG. 12C, an alternative embodiment of the lens 30 is designated as 1200A" and an alternative embodiment of the heat sink 26 is designated as 1210A'. The lens 1200A' includes the pair of opposing, inwardly projecting ridges 1202A and additionally a pair of inwardly projecting L-shaped ridges 1204A'. The heat sink 1210A' includes the pair of inwardly set grooves 1212A' formed in a pair of outwardly projecting appendages 1216A'. The pair of opposing, inwardly projecting ridges 1202A are configured to snap into the grooves 1212A'.

The heat sink 1210A' further includes a pair of downwardly projecting ridges 1215A'. The pair of inwardly projecting L-shaped extension 1204A' are configured to grab the ridges 1215A' to prevent the lens 1200A" from disengaging from the heat sink 1210A' if the bottom 1201 of the lens is deformed in a direction A illustrated in FIG. 12C. Furthermore, the when snapped over the ridges 1215A', the L-shaped extensions 1204A' hold the substrate 12 in place in a friction fit. Thus, rather than being slid through a groove, the substrate 12 is placed onto the heat sink 1210A' during assembly, and the lens 1200A" is snapped onto the heat sink 1210A' to secure the substrate 12 in place.

Figure 13A:
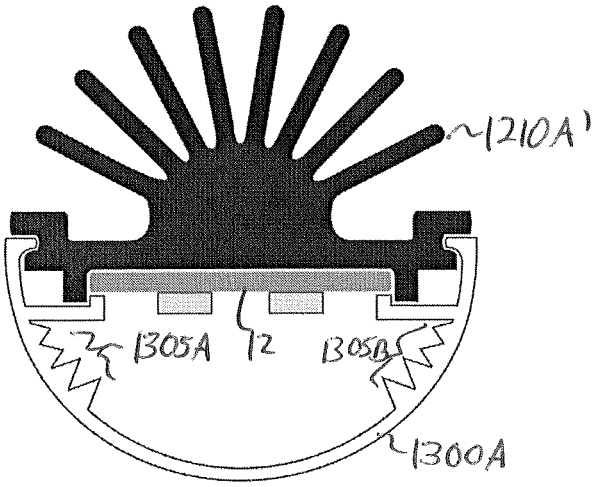
FIGS. 13A and 13B illustrate additional embodiments of the lens of FIG. 12C, in accordance with an exemplary embodiment of the present invention.
Figure 13B:
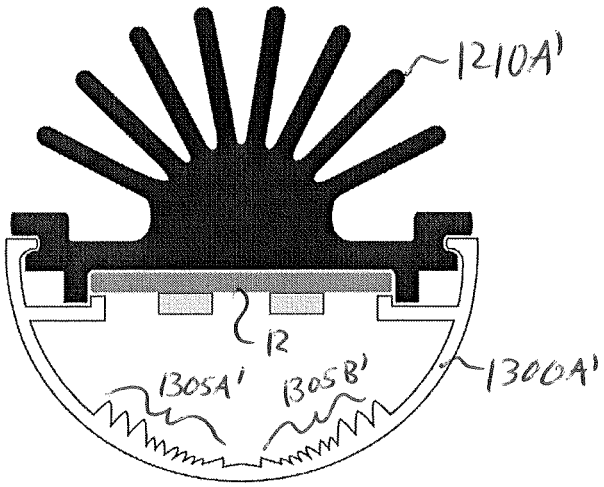

In an exemplary embodiment, the light-emitting elements 18 of the lighting device 12 cast light in a cone of 120°. The lens 30 of the lighting device 14 may be provided with bevels to alter the beam spread of the light cone. Illustrated in FIG. 13A is an exemplary embodiment of the lighting device illustrated in FIG. 12C. In FIG. 13A, the lens 1200A" of FIG. 12C has been modified, as a lens 1300A, to include bevels 1305A and 1305B in the periphery thereof. These bevels 1305A and 1305B may be dimensioned to widen the angle of the light cone or may be dimensioned to not alter the angle of the projected light cone but may, instead, make it brighter at its periphery. Illustrated in FIG. 13B is another exemplary embodiment of the lighting device illustrated in FIG. 12C. In FIG. 13B, the lens 1200A" of FIG. 12C has been modified, as a lens 1300A', to include bevels 1305A' and 1305B' in the central area thereof. These bevels 1305A' and 1305B' focus the light cone to have a spread of about 60°.

Figure 14:
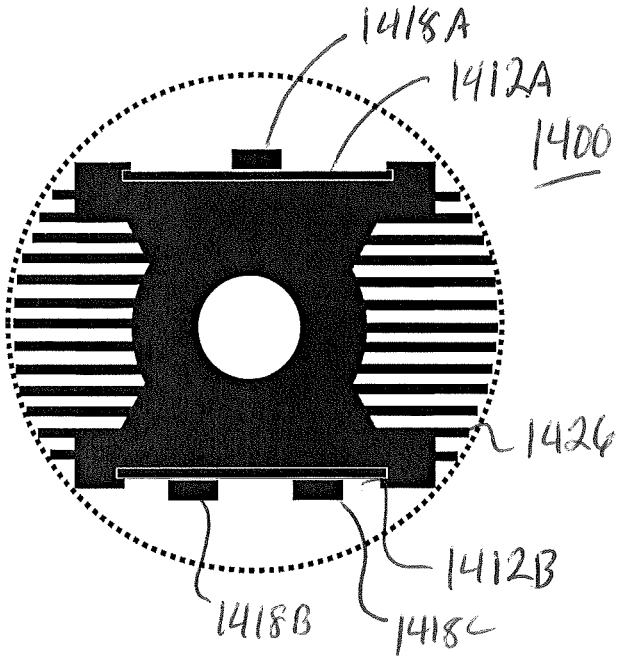
FIGS. 14 and 15 illustrate additional embodiments of the lighting device of FIG. 1, in which the heat sink provides for securing a plurality of light-emitting elements for casting light cones in more than one direction, in accordance with an exemplary embodiment of the present invention.

As illustrated in FIGS. 2 and 3, the lighting devices 14, 34A, and 34B may secure one linear substrate. It is to be understood that the lighting devices may secure a plurality of linear substrates. Turning now to FIG. 14, there is illustrated a lighting device 1400 comprising a heat sink 1426 securing two substrates 1412A and 1412B in parallel on opposite sides of the heat sink 1426. The top substrate 1412A comprises one row of light-emitting elements 1418A, and the bottom substrate 1412B comprises two rows of light-emitting elements 1418B and 1418C.

Figure 15:
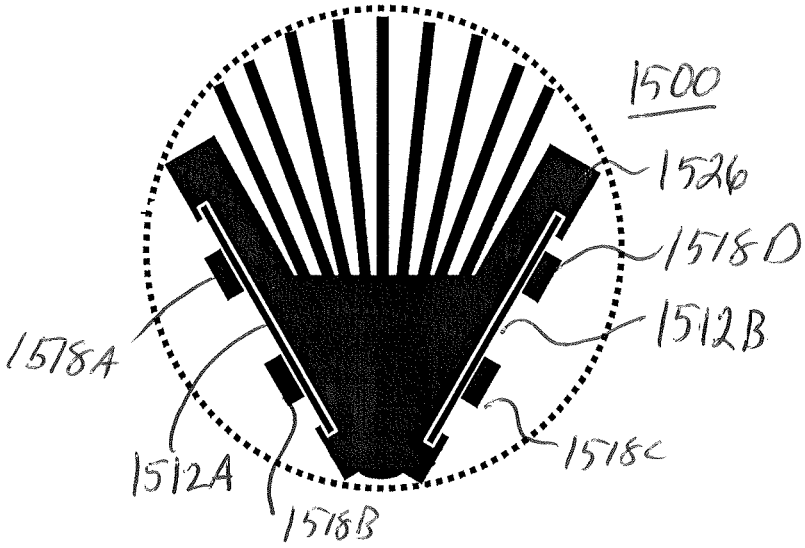

In FIG. 15, there is illustrated a lighting device 1500 comprises a heat sink 1526 securing two substrates 1512A and 1512B in a V-shaped arrangement. The left substrate 1512A comprises two rows of light-emitting elements 1518A and 1518B, and the right substrate 1512B comprises two rows of light-emitting elements 1518C and 1518D.

The arrangements of the substrates in FIGS. 14 and 15 allow for further lighting options. The lighting device 1400 allows for direct and indirect light from a single lighting device. The lighting device 1500 allows for greater lighting coverage from a single lighting device than one having only a single substrate.

The lighting systems described herein may also comprise various software components/modules for managing power, light, and thermal requirements. For example, the system 10 may also include a communication system such that data can be sent to and received from the lighting device 14 for management of the artificial lighting of the lighting device 14.

In terms of increased energy savings and control, the direct to linear system driver power supply system described herein provides great flexibility. Given the increasing demand for occupancy sensors, daylight harvesting, and timer controls, the independent direct to linear system driver power supply system gives facility managers sophisticated options for smart controls. By analyzing past patterns, the facility manager (e.g., a human and/or a computer hardware/software system) may make predictive decisions that may reduce overall energy consumption or optimize some process.

As an example, the parking garage 70 of FIG. 7 may call for reduced foot-candles in certain areas at certain times of the day/year, or under certain light conditions. To accomplish this, each lighting system 71A-C may operate with a sensor for managing and controlling power and light requirements and controlling the thermal properties of each lighting device. The information or data collected by the sensors may be fed directly back into a lighting management system such that the information can be acted on locally.

Figure 16:
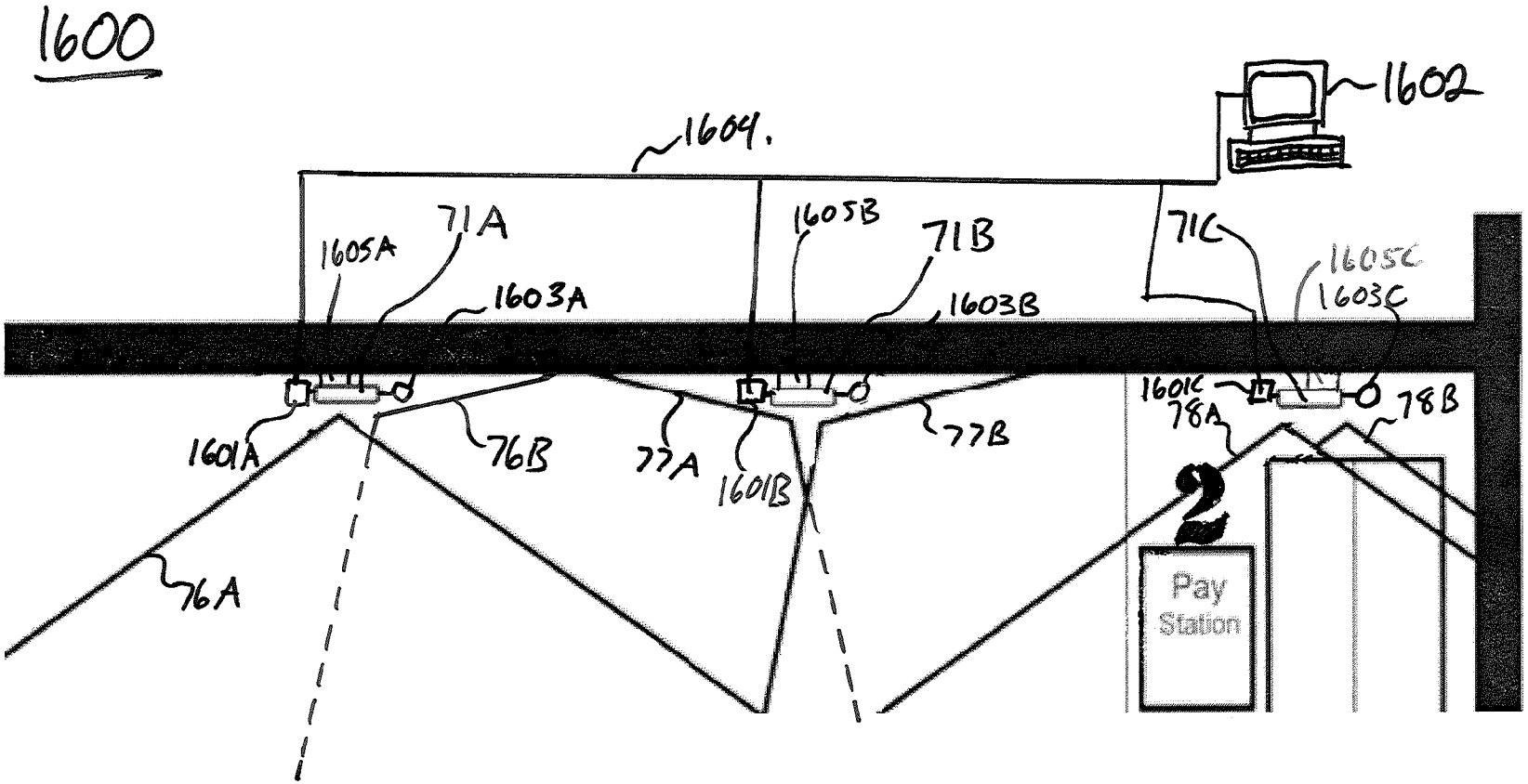
FIG. 16 illustrates a control system for controlling the plurality of lighting devices installed in the parking structure of FIG. 7, in accordance with an exemplary embodiment of the present invention.

Referring now to FIG. 16, there is illustrated an exemplary lighting control system, generally designated at 1600, in accordance with an exemplary embodiment of the present invention. The control system, 1600 comprises a plurality of local controllers 1601A-C respectively coupled to the lighting systems 71A-C. The controller 1601A is coupled to the lighting system 71A; the controller 1601B is coupled to the lighting system 71B; and the controller 1601C is coupled to the lighting system 71C. The controllers 1601A-C are connected to a remote computer 1602, which controls the lighting systems 71A-C remotely by sending commands to the controllers 1601A-C electrically. In an exemplary embodiment, the controllers 1601A-C are connected to the computer 1602 via a network 1604. Examples of the network 1604 include a wide area network, such as the Internet, or a local area network, such a Wi-Fi network, Ethernet network, etc.

The local controllers 1601A-C control the lighting devices in each of the respective lighting systems 71A-C. In an exemplary embodiment, the local controllers 1601A-C may selectively turn on and turn off the lighting devices in each of the respective lighting systems 71A-C to customize the light cones 76A-B, 77A-C, and 78A-C to satisfy lighting needs. Such selective operation of the lighting devices is possible as each lighting device is powered by a separate power supply. The selective control may be performed under direction of a human operating the computer 1602 or as part of a software program stored within the computer 1602, which software program comprises software instructions that, when executed by the computer 1602, selectively control the lighting devices.

In an exemplary embodiment, each lighting system comprises an ambient light sensor. For example, the lighting system 71A is coupled to an ambient light sensor 1603A; the lighting system 71B is coupled to an ambient light sensor 1603B; and the lighting system 71C is coupled to an ambient light sensor 1603C. Each ambient light sensor 1603A-C detects light intensity and provides a signal to the local controllers 1601A-C, respectively, indicating the light intensity. The local controllers 1601A-C may be programmed to process such signals or may be programmed to send such signals to the computer 1602 over the network 1604.

In the embodiment in which the light intensity signals are provided to the computer 1602, the computer 1602 receives the light-intensity signals from the local controllers 1601A-C and determines whether the measured light level is acceptable. The computer 1602, as a result, instructs the local controllers 1601A-C to change the light emitted from the lighting systems 71A-C (e.g. changing intensity, color temperature, beam angle, etc.) to bring the measure ambient light within desired ranges. Since each lighting device in the lighting systems 71A-C is powered by separate power supplies, each lighting device may controlled to alter its intensity, color temperature, beam angle, etc.

In the embodiment in which the light intensity signal is provided to the local controllers 1601A-C, the local controllers 1601A-C receive their respective light-intensity signals from the ambient light detectors 1603A-C and determine whether the measured light levels are acceptable by comparing them to set points programmed in the local controllers 1601A-C by the computer 1602. The local controllers 1601A-C, as a result, change the light emitted from the respective lighting systems 71A-C (e.g. changing intensity, color temperature, beam angle, etc.) to bring the measured ambient light within desired ranges. Since each lighting device in the lighting systems 71A-C is powered by separate power supplies, each lighting device may controlled to alter its intensity, color temperature, beam angle, etc.

In a further exemplary embodiment, each local controller 1601A-C is coupled to one or more servomechanisms 1605A-C, which are, respectively, connected to each lighting device in the lighting systems 71A-C. The servomechanisms 1605A-C are configured to rotate the lighting devices under command from the local controllers 1601A-C. For example, if any of local controllers 1601A-C or the computer 1602 determines that a respective light cone 76A-B, 77A-B, or 78A-B is directed in a non-optimal direction, as sensed by a respective ambient light detector 1603A-C, such local controller may command the servomechanism to rotate the respective lighting device to correct the direction of the light cone.

In an exemplary embodiment, a person, using the computer 1602, may program the local controllers 1601A-C and the lighting systems 71A-C for operation throughout the day. For example, the person (operator) may establish five time periods in a day each with different lighting settings: (1) morning rush hour (6 a.m. through 10 a.m.); (2) mid day (10 a.m. through 4 p.m.); (3) evening rush hour (4 p.m. through 7 p.m.); (4) evening (7 p.m. through 12 a.m.); and (5) early morning (12:00 a.m. through 6 a.m.). The operator may then program the local controllers 1601A-C for full illumination during the morning rush hour and evening rush hour, partial illumination for the mid-day period, and low illumination for the evening and early morning periods. The local controllers 1601A-C will then operate the lighting system 71A-C as programmed.

In periods (1) and (3), the local controllers 1601A-C turn on each lighting device in the lighting systems 71A-C to provide the exemplary parking garage 70 with six lighting devices at 100% illumination. In period (2), the local controllers 1601A-C shut off two lighting devices, for example one lighting device in each of lighting systems 71A and C, and power on the remainder so that a total of four lighting devices are on, thereby providing 66% illumination. In periods (4) and (5), the local controllers 1601A-C shut off four lighting devices, for example one lighting device in each of lighting systems 71A and C and both in the lighting system 71B, and power on the remainder so that total of two lighting devices are on, thereby providing 33% illumination, which desirably meets the minimum federal foot-candle requirements.

Control of the local controllers 1601A-C in further exemplary scenarios is contemplated. For example, in period (2), the ambient light detector 1603A may detect sufficient ambient light passing through the opening 75. Accordingly, the local controller 1601A may power off both lighting devices in the lighting system 71A. Both lighting devices in the lighting system 71B remain on to illuminate the drive path 79A, and one lighting device in the lighting system 71C remains on to illuminate the elevator landing 79B and pay station 79C. A like modification to illumination in periods (1) and (3) is contemplated, and still other modifications are contemplated. For example, control of the lighting systems 71A-C from Friday after rush hour to Monday before rush hour and during a snow day may follow the illumination during periods (4) and (5).

In an exemplary embodiment, each ambient light sensor 1603A-C is equipped with a motion sensor for detecting motion within the parking garage 70. In such embodiment, the local controllers 1601A-C may operate the lighting devices 71A-C as in periods (4) and (5). When one of the motion sensors detects motion, the local controllers 1601A-C may power on respective ones of the lighting devices 71A-C in accordance with lighting in any of periods (1)-(3), depending upon ambient light conditions.

The lighting systems according to the exemplary embodiments described herein reduce the amount of heat received by the light-emitting elements, e.g., the core semi-conductor chip inside each diode, therein. Given that fluorescent tube fixtures are designed with spaces for the ballasts, positioning the external power supply driver in the ballast location during above-described retrofit installation provides more distance between the light-emitting elements and the power supplies.

The lighting systems according to the exemplary embodiments described herein are also advantageous in the event of failure of a lighting device. Because conventional lightings systems with internally located dependent power supply systems are more likely to fail inside of the time period of the warranty, providers and/or manufacturers may be required to replace the burned-out lighting devices, regardless of the reason for failure, wasting what are often more than 240 semi-conductors in the process. This is far from a logical or sustainable model, and it is also a tenuous financial risk on the supply side. The cost may be, e.g., many times that of replacing only the direct to linear system driver power supply.

The size of the power supply is also a key factor in the efficiency of the entire lighting system. Capacitor size and quality is often restricted inside of very tight spaces, e.g., the channel behind the diodes. An external, direct to linear system driver power supply does not have the size restrictions to fit inside the linear system. This flexibility allows more room to incorporate larger capacitors, which in turn allows the lighting devices to run more efficiently. As an example, direct to linear system driver power supply typically has a volume that is at least twice the size of an equivalent dependent power supply at 7 cubic inches or greater.

When it comes to increased output options, a direct to linear system driver power supply enables a wider selection of linear system wattage for different applications. Direct to linear system driver power supply provides much more flexibility for expansion given its external location, e.g., in the location that was formerly for the ballast of a fluorescent tube lighting fixture.

Installing a direct to linear system driver power supply for a linear system is similar to replacing the ballast in a fluorescent fixture. Given that the panels are designed to conceal the ballasts, the power supply fits inside the channel. Furthermore, in the event of failure by one linear system in a system using direct to linear system driver power supply, the other linear systems stay lit. This is a practical convenience in terms of timing to reduce the urgency of replacing linear systems in a whole fixture that may otherwise go dark.

Furthermore, when it comes to installation, the clip system (i.e., fastener 32 of FIG. 2) offers additional ease of installation and maintenance. The clip system not only protects the circuit continuity, but it also gives the installer the ability to quickly link the linear system to the power supply. Likewise, if facility managers elect to change the linear system color temperatures, they can quickly unclip the linear systems and clip an alternate product into position. Also, if any of the diodes fail in a linear system, the facility managers can quickly clip a replacement into position.

In embodiments where a lighting system according to one of the exemplary embodiments described herein is replacing an existing fluorescent linear system(s), there is no reliance upon the tombstone fixture for power. That is, because the lighting devices 14, 34, etc. receive power from the externally located and independent direct to linear system driver power supply, the tombstone is only used to physically support the lighting devices 14, 34, etc. This reduced reliance upon tombstone fixtures eliminates 'arching' issues present with faulty tombstones, which creates a significant maintenance advantage for the lighting systems according to the exemplary embodiments described herein.

The asymmetrical advantage of a direct to linear system driver power supply system comes in several forms. Since each linear system is run off of a different supply, the facility managers can choose to customize the output of each individual linear system within the same fixture. The variables include color, temperature, wattage, the angle of light, etc. Since the tombstone is free of electrical charge, the facility manager can angle the linear system to the desired position. Unlike internally located dependent power supply, in which the only option is a straight down position given that the linear system goes dark when it is rotated in the tombstone away from the horizontal circuit connection, the direct to linear system driver power supply system/fixture allows for a variety of other directional choices, as discussed above. The variables are numerous, and facility managers can tailor the lighting to their needs accordingly.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiments were chosen and described in order to best explain the principles of the present invention and its practical application, to thereby enable others skilled in the art to best utilize the present invention and various embodiments with various modifications as are suited to the particular use contemplated.

What is claimed is:

1. A lighting system, comprising:

a first lighting device comprising a first substrate, a first plurality of light-emitting elements mounted on the first substrate, and a first power terminal;

a first rotational component mounted to the first lighting device and configured to rotate the first substrate;

a second lighting device comprising a second substrate, a second plurality of light-emitting elements mounted on the second substrate, and a second power terminal;

a second rotational component mounted to the second lighting device and configured to rotate the second substrate; and a power supply driver electrically coupled to the first power terminal to provide power to the first plurality of light-emitting elements, the power supply driver located externally to the first lighting device, wherein rotation of the first substrate by the first rotational component is independent of rotation of the second substrate by the second rotational component.

2. The system of claim 1, wherein the first lighting device comprises a first opening, the lighting system further comprising an electrical conductor coupling the first lighting device to the power supply driver, the electrical conductor protruding through the first opening in the first lighting device.

3. The system of claim 1, wherein the power supply driver is a first power supply driver electrically coupled to the first power terminal to provide power to the first plurality of light-emitting elements, the system further comprising a second power supply driver electrically coupled to the second power terminal to provide power to the second plurality of light-emitting elements independently of the first power supply driver.

4. The system of claim 1, further comprising a lighting fixture, wherein the first rotational component rotatably mounts the first lighting device in the fixture, and the second rotational component rotatably mounts the second lighting device in the fixture.

5. The system of claim 4, further comprising:

a first rotational device comprising:

a first fixed housing component affixed to the lighting fixture;

the first rotational component, wherein the first rotational component is a first rotatable housing component connected to the first lighting device, the first rotatable housing component configured to rotate relative to the first fixed housing component; and at least one first fastener for rotatably locking the first rotatable housing component relative to the first fixed housing component; and a second rotational device comprising:

a second fixed housing component affixed to the lighting fixture;

the second rotational component, wherein the second rotational component is a second rotatable housing component connected to the second lighting device, the second rotatable housing component configured to rotate relative to the second fixed housing component; and at least one second fastener for rotatably locking the second rotatable housing component relative to the second fixed housing component.

6. The system of claim 5, wherein the at least one first fastener comprises at least one first groove disposed on an inner surface of the first fixed housing component and at least one first protrusion disposed on an outer surface of the first rotatable housing component, and wherein the at least one second fastener comprises at least one second groove disposed on an inner surface of the second fixed housing component and at least one second protrusion disposed on an outer surface of the second rotatable housing component.

7. The system of claim 1, wherein the first lighting device further comprises a heat sink onto which the first substrate is secured.

8. A lighting control system, comprising:

at least one lighting system comprising at least a first lighting device powered by a first power supply and a second lighting device powered by a second power supply;

at least one controller coupled to the at least one lighting system for controlling operation of the first and second lighting devices;

an ambient light sensor coupled to the at least one controller, the ambient light sensor configured to generate an ambient light signal indicative of sensed light intensity and to provide the ambient light signal to the at least one controller; and a first servomechanism connected to the first lighting device and a second servomechanism connected to the second lighting device, the first and second servomechanisms coupled to the at least one controller, wherein:

the first and second lighting devices are rotatably mounted within the at least one lighting system, the at least one controller is configured to receive the ambient light signal and to turn on or turn off the first and second lighting devices based on the received ambient light signal, and the at least one controller is further configured to operate the first and second servomechanisms to rotate the first and second lighting devices, respectively, based on the received ambient light signal.

9. The lighting control system of claim 8, further comprising a remote computer coupled to the at least one controller by a network, the remote computer configured to receive one or more setpoints from an operator and to program the at least one controller based on the one or more setpoints.

10. The lighting control system of claim 8, wherein the at least one controller is programmed to turn on the first lighting device during a first set of time periods during a day and to turn on the second lighting device during a second set of time periods during the day.

11. A lighting device, comprising:

a substrate;

a plurality of light-emitting elements coupled to the substrate;

a power terminal configured to be coupled to a power supply driver located externally to lighting device; and a rotational device for rotating the substrate along at least one rotational axis of the substrate independently from a substrate of another lighting device.

12. The lighting device of claim 11, wherein the rotational device comprises a rotatable housing component connected to the lighting device, the rotatable housing component configured to mate with a fixed housing component connected to a support assembly to rotate relative to the fixed housing component independently from another lighting device.

13. The lighting device of claim 11, further comprising a heat sink to which the substrate is mounted.

14. The lighting device of claim 11, further comprising a translucent cover positioned over the plurality of light-emitting elements.

15. The lighting device of claim 14, wherein the translucent cover comprises a plurality of bevels for altering a shape of light projected by the plurality of light-emitting elements.

* * * * *